United States Patent [19]

Shriver

[11] Patent Number: 4,750,420

[45] Date of Patent: Jun. 14, 1988

[54] ROTATABLE CAM FOR SKIP-PRINT MANDREL WHEEL ASSEMBLY

[75] Inventor: Frank L. Shriver, Lakewood, Colo.

[73] Assignee: Adolph Coors Company, Golden, Colo.

[21] Appl. No.: 116,386

[22] Filed: Nov. 3, 1987

[51] Int. Cl.[4] ..... B41F 17/22

[52] U.S. Cl. ..... 101/40

[58] Field of Search ..... 101/40, 39, 38 A, 38 R

[56] References Cited

U.S. PATENT DOCUMENTS

| | | | |
|---|---|---|---|
| 3,356,019 | 2/1966 | Zurick | 101/39 |
| 3,521,554 | 5/1967 | Zurick | 101/40 |
| 3,665,853 | 5/1972 | Hartmeister et al. | 101/247 |
| 3,851,579 | 12/1974 | Zurick | 101/39 |
| 4,037,530 | 7/1977 | Sirvet | 101/40 |
| 4,498,387 | 2/1985 | Stirbis | 101/40 |

*Primary Examiner*—Clifford D. Crowder

*Attorney, Agent, or Firm*—Klaas & Law

[57] ABSTRACT

A mandrel assembly for use in a machine for the continuous printing of cylindrical containers, comprising a mandrel wheel; mandrel holders, pivotally mounted on circumferential portions of the mandrel wheel; elongated spindles for supporting cylindrical containers on the peripheral surfaces thereof, rotatably mounted on the mandrel holder and radially displaceable relative to the central axis of rotation of the mandrel wheel; a cam follower rotatably mounted on each mandrel holder; a cam track assembly operably associated with the cam followers for causing preselected radial displacement of the cam followers with respect to the central axis of rotation of the mandrel wheel which in turn causes preselected radial displacement of associated mandrel spindles relative to a printing blanket wheel device to cause a container to be printed; skip-print apparatus comprising a pivot arm pivotally mounted on the mandrel wheel and rotatable relative to each mandrel holder and having a surface bearing against a rotatable cam having a first cam surface for permitting printing of the cylindrical container and a second cam surface for positioning the mandrel holder at a radially inward location so that an elongated spindle or an improperly positioned cylindrical container thereon will not contact the printing blanket wheel device and control means for rotating or not rotating the rotatable cam.

20 Claims, 4 Drawing Sheets

ROTATABLE CAM FOR SKIP-PRINT MANDREL WHEEL ASSEMBLY

FIELD OF THE INVENTION

The present invention relates to a high speed continuous decorator machine for decorating cylindrical containers such as can bodies and, more specifically, relates to a mandrel wheel assembly comprising apparatus for moving a mandrel spindle having an improperly seated can or no can thereon out of printing relationship with an associated blanket wheel to avoid printing of the mandrel spindle exterior surface.

BACKGROUND OF THE INVENTION

Can printing or decorating machines, especially high speed continuous can printing machines, operate by the impingement of a rotating, image-carrying blanket wheel and an oppositely rotating can carrying mandrel wheel assembly. The blanket wheel comprises an endless blanket which is at least as wide as the length of the cans being printed. The blanket carries a series of wet ink images circumferentially spaced on its resilient periphery. The mandrel wheel assembly comprises a mandrel wheel mounted with a series of circumferentially spaced, rotatable mandrel spindles over which cans are fitted. The cans rotate on the mandrel wheel into registry and contact with the images on the surface of the blanket wheel. Each mandrel spindle generally includes structure for removing cans from or drawing cans onto the mandrel spindle.

During high speed printing, a can will occasionally fail to properly seat on a mandrel spindle or a gap will occur in the continuous can infeed to the machine causing one or more mandrel spindles not to have a can received thereon. In such circumstances, it is necessary that the mandrel spindle not be moved into contact with the blanket wheel to prevent the mandrel spindle surface from being printed. A number of different mechanisms have been utilized in the past to provide such a "skip-print" feature, such as U.S. Pat. Nos. 3,665,583 to Hartmeister et al.; 4,037,530 to Sirvet and 4,498,387 to Stirbis, all of which are incorporated herein by reference thereto.

In apparatus accomplishing the "skip-print" feature, it is highly desirable to locate the sensing apparatus as close as possible to the intended point of contact with the printing blanket wheel means. As the speed of the processing system is greatly increased, the time for response to the sensing apparatus to move the mandrel spindle and any cylindrical container thereon away from the printing path is greatly reduced. In prior art devices, it has been necessary to limit the speed of the processing system or to move the sensing apparatus further away from the point of contact of the cylindrical container with the printing wheel blanket means in order to move the mandrel spindle out of the printing path.

BRIEF DESCRIPTION OF THE INVENTION

This invention provides a skip-print means that is responsive to a control signal from a sensing apparatus to operate apparatus to move a cam surface so that an elongated mandrel spindle means and any cylindrical container thereon will follow a path wherein the elongated mandrel spindle means and any cylindrical container thereon will not contact the printing wheel blanket device and wherein such movement is accomplished in an elapsed time period substantially less than the time period required by known prior art devices to accomplish the same result.

In a preferred embodiment of the invention there is provided a mandrel wheel means having apparatus for supporting a plurality of cylindrical containers thereon. The mandrel wheel means has a central axis of rotation which is in parallel relationship with a central axis of rotation of an associated blanket wheel means carrying a printing medium thereon for printing on the cylindrical containers carried by the mandrel wheel means. A plurality of mandrel holder means are pivotally mounted at spaced apart locations on the circumferential portion of the mandrel wheel means for pivotal movement around mandrel holder pivot axes that are parallel to each other and to the axis of rotation of the mandrel wheel means. Elongated mandrel spindle means are rotatably mounted on each of the mandrel holder means for rotation around an axis which is in substantially parallel, non-coaxial relationship with the pivot axis of the mandrel holder means whereby the elongated mandrel spindle means are radially displaceable relative to the central axis of rotation of the mandrel wheel means by pivotal movement of the mandrel holder means around the pivot axis of the mandrel holder means. Cam follower means are rotatably mounted on the mandrel holder means for rotation about an axis of rotation which is in substantially parallel, noncoaxial relationship with the mandrel holder pivot axis whereby the mandrel holder means are pivotally displaced about the mandrel holder pivot axis by radial displacement of the cam follower means relative to the central axis of rotation. Cam track means are mounted for controlling the location of and guiding the cam follower means to cause preselected relative radial displacement of the cam follower means with respect to the central axis of the mandrel wheel means and therefore radial displacement of the elongated mandrel spindle means relative to the blanket wheel device whereby, when the mandrel wheel means is in a normal operating state wherein the elongated mandrel spindle means has a cylindrical container properly seated thereon, the elongated mandrel spindle means is positioned to urge the cylindrical container positioned thereon into printing contact with the blanket wheel means. Skip printing means are provided for moving the mandrel holder means and the elongated mandrel spindle means to a radially inward location so that the elongated mandrel spindle means and any cylindrical container thereon will not contact the blanket wheel means. Control means are provided for sensing the position of a cylindrical container on an elongated mandrel spindle means or the absence of a cylindrical container on the elongated mandrel spindle means and to actuate the skip printing means in response to an improperly positioned cylindrical container or the absence of a cylindrical container on the elongated mandrel spindle means.

In the preferred embodiment of the invention, the skip-print means comprise pivot arm means pivotally mounted on the mandrel wheel means and rotatably connected to the mandrel holder means. Rotatable cam means are mounted for rotation about a fixed axis on the mandrel wheel and have a first cam surface for cooperation with the pivot arm means in holding a cylindrical container on an elongated mandrel spindle means in a position to move into printing contact with the blanket wheel device and a second cam surface for cooperation with the pivot arm means in holding an empty elongated mandrel spindle means or an elongated mandrel spindle means and any cylindrical container improperly seated thereon in a radially inward location so that an empty elongated mandrel spindle means or any cylindrical container improperly seated on an elongated mandrel spindle means will not contact the blanket wheel means. Adjustable contact stud means are mounted on the pivot arm means and force applying means are positioned to urge the adjustable contact stud means into contact with the first or second cam surface. Rotation producing means are provided for rotating the rotatable cam means to move the first or second cam surface into a position to be contacted by the adjustable contact stud means.

BRIEF DESCRIPTION OF THE DRAWINGS

An illustrative and presently preferred embodiment of the invention is shown in the accompanying drawing in which.

DETAILED DESCRIPTION OF THE INVENTION

Figure 1:
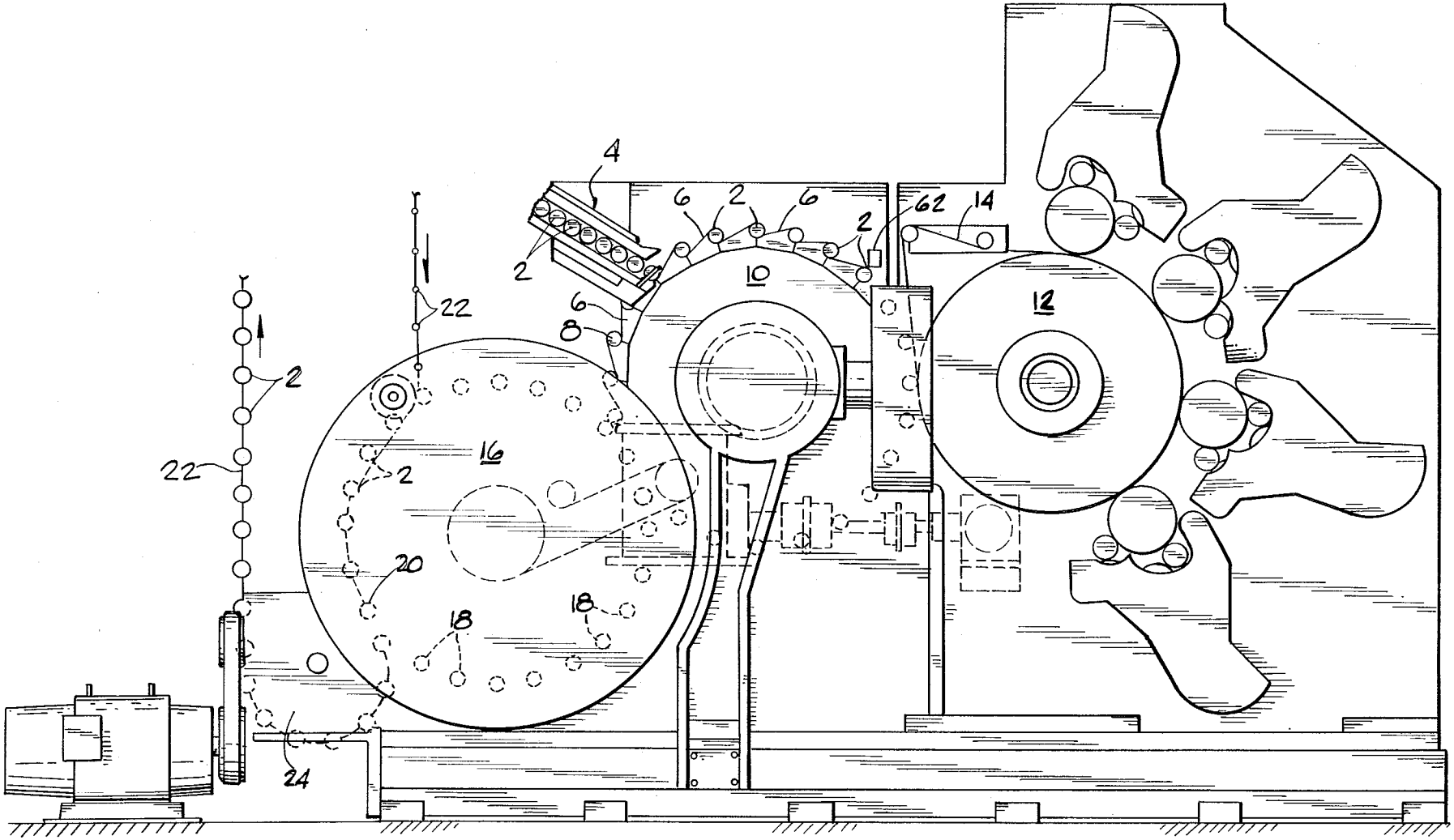
FIG. 1 is a front elevational view of a can printing or decorating machine embodying this invention.

A can printing or decorating machine is illustrated in FIG. 1 wherein cylindrical containers 2, such as aluminum cans, are fed through infeed chute 4 into pocket means 6. In the embodiment of FIG. 1, there are twenty-four pocket means 6 and twenty-four mandrel holder means 8 although other numbers may be used. Each pocket means 6 receives a cylindrical container 2 which is transferred to the mandrel holder means 8. Mandrel wheel means 10 rotates to bring each cylindrical container 2 into contact with printing blanket wheel means 12 to print the external wall of a cylindrical container 2. Belt 14 is powered by the printing blanket wheel means 12 and functions to rotate each cylindrical container 2 to result in smudge-free printing when the cylindrical container moves into contact with the surface of the printing blanket wheel means 12. Following the printing operation, the mandrel wheel means 10 carries the printed cylindrical container 2 to a transfer wheel 16 where the cylindrical containers are blown from the mandrel wheel means onto suction cups 18 and in transfer area 20 the suction cups 18 guide each cylindrical container 2 onto pin conveyor chain 22 driven by drive means 24.

Figure 2:
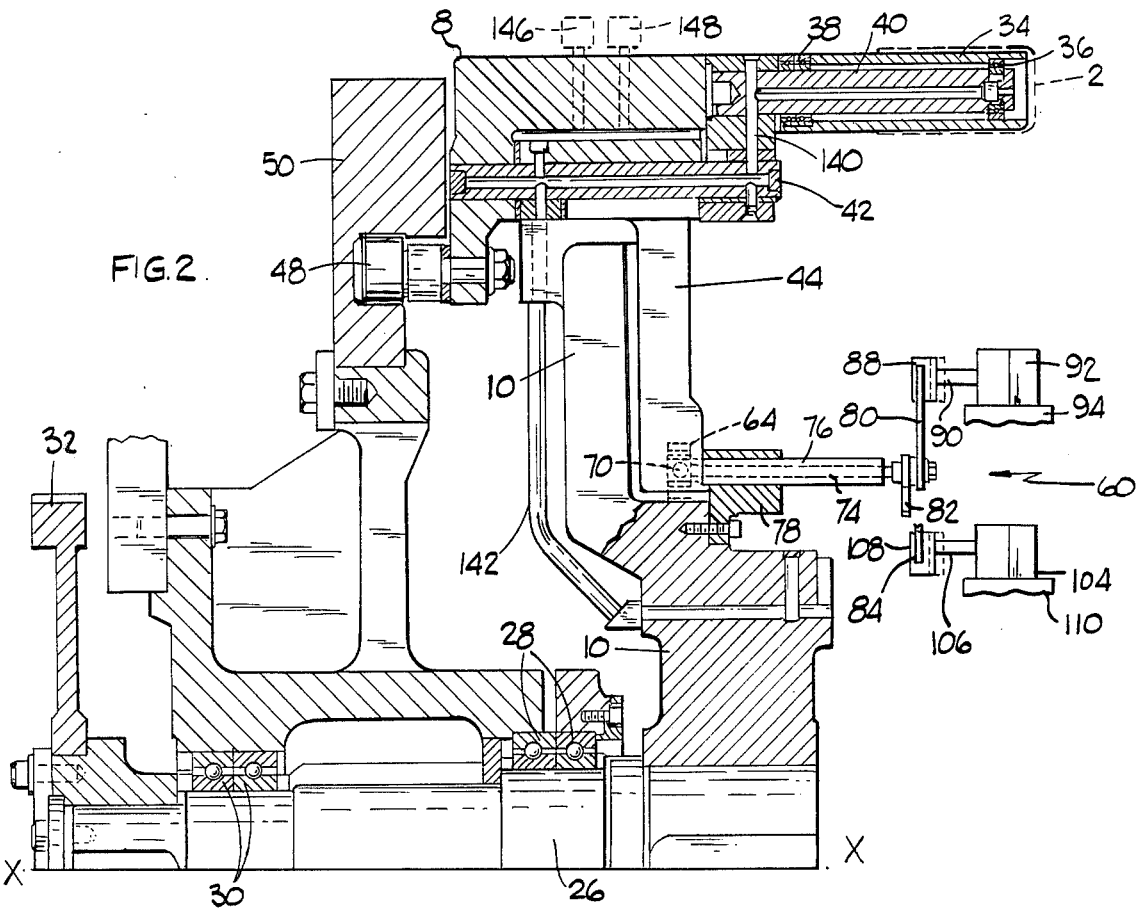
FIG. 2 is a transverse sectional view, partly diagrammatic, of a portion of the mandrel wheel means of FIG. 1.
Figure 3:
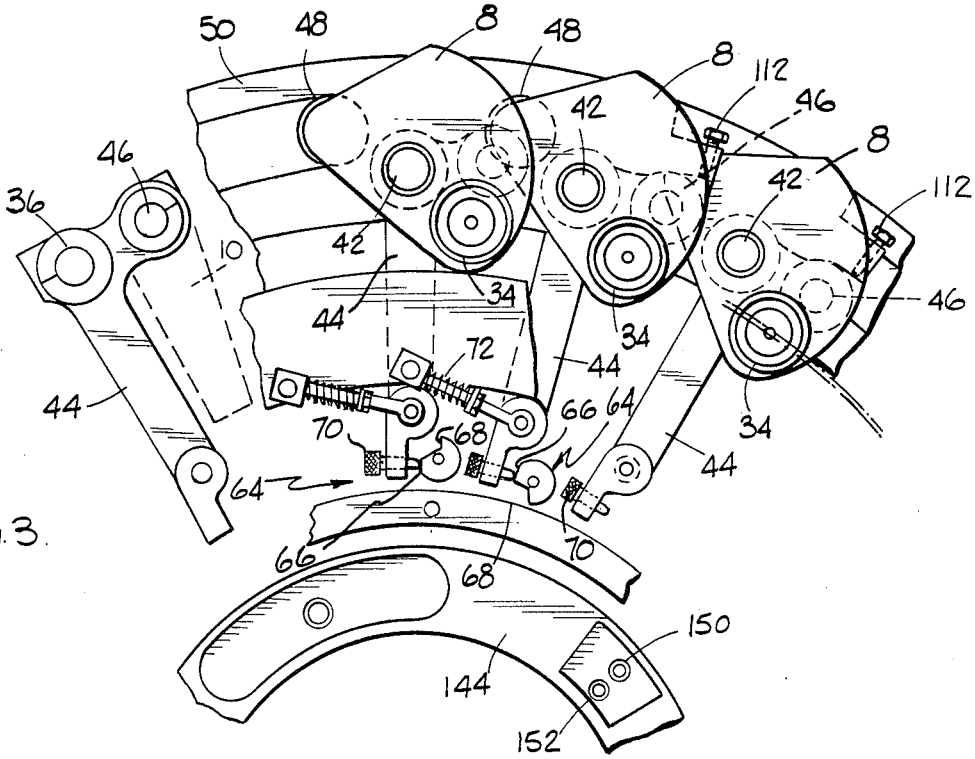
FIG. 3 is a front elevational view of a portion of the mandrel wheel means of FIG. 1.

As illustrated in FIG. 2, the mandrel holder means 8 are mounted on mandrel wheel means 10 which is keyed to shaft 26 having a central axis of rotation X-X. The shaft 26 is supported on bearings 28 and 30 and is continuously rotated by gear 32 through an appropriate mechanism.

Each mandrel holder means 8 has an elongated mandrel spindle means 34 mounted thereon for substantially friction free rotation by bearings 36 and 38 secured to an elongated support member 40. Each mandrel holder means 8 is rotatably mounted on a pivot pin 42 which is mounted in pivot arm means 44 which are pivotally mounted on a pivot pin 46 fixedly secured to the mandrel wheel means 10. Also, each mandrel holder means 8 is pivotally mounted on the fixed pivot pin 46. A rotatable cam follower means 48 mounted on each mandrel holder means 8 is positioned in a cam track means 50 which guides the movement of the cam follower means 48 to cause relative radial displacement thereof with respect to the central axis of rotation of the mandrel wheel means 10 and to pivot the mandrel holder means 8 around the pivot pin 42 to cause radial displacement of the elongated mandrel spindle means 34 relative to the central axis of the mandrel wheel means 10 whereby, when the mandrel wheel means 10 is in the normal operating state wherein the elongated mandrel spindle means 34 has a cylindrical container properly seated thereon, the elongated mandrel spindle means 34 is positioned to urge the cylindrical container 2 thereon into contact with the printing blanket wheel means 12.

The invention provides skip-print means 60 which are actuated by control means 62, such as a standard proximity device, illustrated in FIG. 1, which senses the position of or absence of a cylindrical container on the elongated mandrel spindle means 34 and sends a signal to actuate the skip-print means 60 in response to an improperly positioned cylindrical container or the absence of a cylindrical container on the elongated mandrel spindle means 34. The skip-print means 60 will move the elongated mandrel spindle means 34 out of the line of rotation for printing far enough so that neither the elongated mandrel spindle means 34 nor an improperly seated cylindrical container 2 will contact the printing blanket wheel means 12.

The skip-print means 60 include the pivot arm means 44 and a rotatable cam means 64 having a first cam surface 66 for cooperation with the pivot arm means 44 in holding a cylindrical container 2 on an elongated mandrel spindle means 34 in a position to move into printing contact with the printing belt 14 and a second cam surface 68 for cooperation with the pivot arm means 44 in holding the mandrel holder means 8 and the elongated mandrel spindle means 34 at a radially inward location in relation to the central axis of the mandrel wheel means 10 so that an improperly seated cylindrical container on the elongated mandrel spindle means 34 or an empty elongated mandrel spindle means 34 will not contact the printing blanket wheel means 12. An adjustable contact stud means 70, such as a threadedly mounted screw, is mounted on the pivot arm means 44 and a resilient spring 72 functions as a force applying means to urge the adjustable contact stud means 70 in contact with the first 66 or second 68 cam surface.

Figures 4, 9:
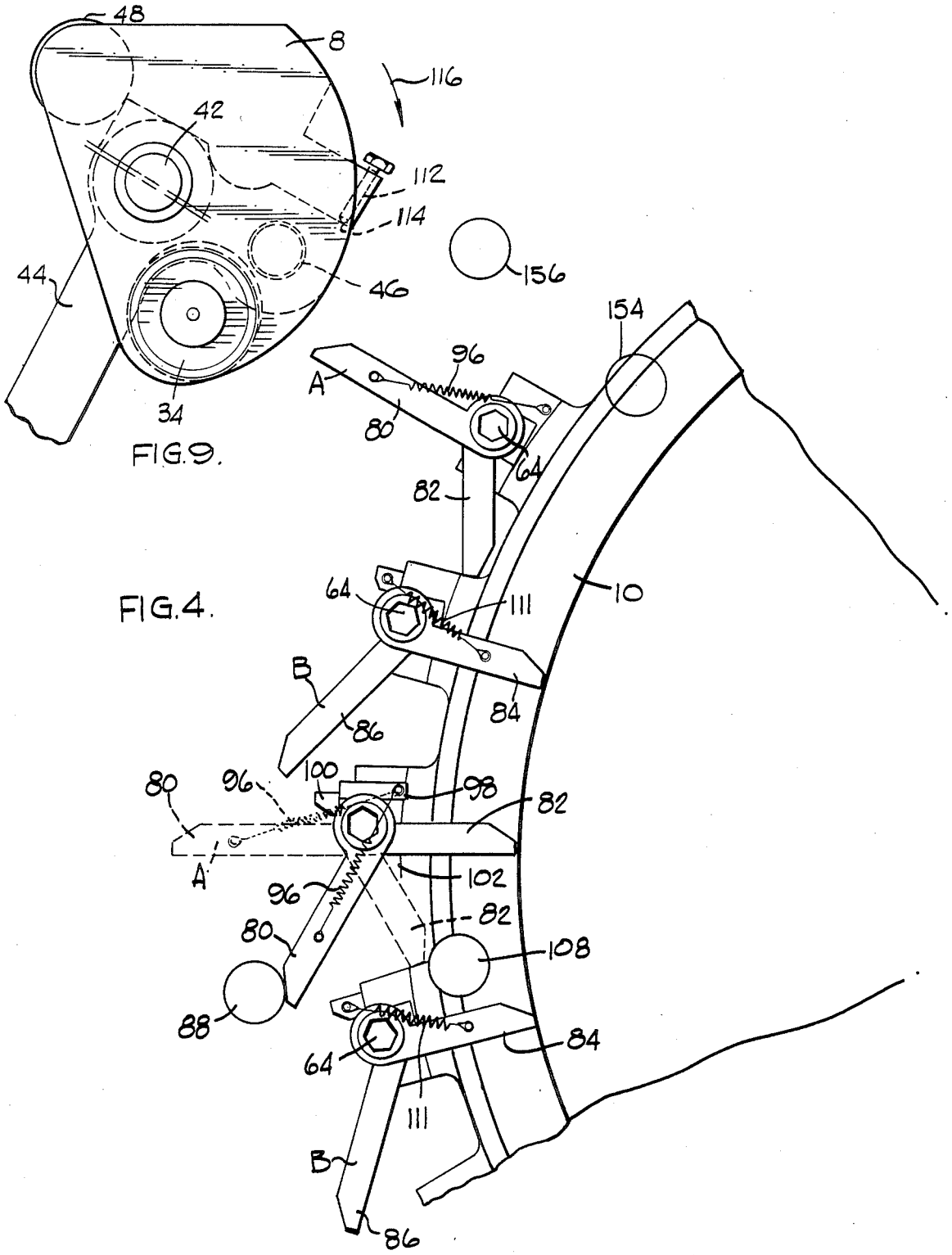
FIG. 4 is a schematic illustration of the cam rotating means of this invention.
FIG. 9 is a schematic illustration of means for moving the pivot arm means for permitting adjustment of the rotatable cam means of this invention.

The rotatable cam means 64 are rotated by rotation producing means, illustrated in FIGS. 2 and 4, comprising an elongated shaft 74 joined at one end to the rotatable cam means 64. The elongated shaft 74 is mounted for rotation in the bearing 76 which is fixedly secured in a support 78 fixedly mounted on the mandrel wheel means 10. A first pair of contact arm means 80 and 82 are secured to the other end of the elongated shaft 74 of every other rotatable cam means 64 indicated as A in FIG. 4. A second pair of contact arm means 84 and 86 are secured to the other end of the elongated shafts 74 of the remaining rotatable cam means 64 indicated as B in FIG. 4. A contact rod means 88 is secured to the free end of a slidable pin means 90 which is moved by a first solenoid means 92. As illustrated in FIG. 2, the solenoid means 92 is secured to a fixed support 94 and located so that the slidable pin means 90 can position the contact rod means 88 at the dotted line position where the contact rod means 88 will not contact the contact arm means 80 or in the solid line position where the contact rod means 88 will contact the contact arm means 80. The solenoid means 92 normally holds the slidable pin means 90 and the contact rod means 88 in the dotted line position and responds to a signal from the control means 62 to move the slidable pin means 90 and the contact rod means 88 to the solid line position. A spring 96 is secured at one end to a fixed support 98 on the mandrel wheel means 10 and at its other end to the contact arm means 80 and functions to releasably hold the contact arm means 80 against a stop 100 in an untripped position, indicated by the dashed line in FIG. 4, or against the stop 102 in the tripped position, indicated by the solid line in FIG. 4. A second solenoid means 104 similar to the first solenoid means 92 and having a slidable pin means 106 and a contact rod means 108 is secured to a fixed support 110 and located so that the contact rod means 108 can be moved to a position to contact the contact arm means 84 when desired. A spring 111 functions in the same manner as spring 96 to hold the contact arm means 84 in an untripped or tripped position.

In FIG. 9, there is illustrated means to move the pivot arm means 44 against the pressure of the spring 72 to move the adjustable contact stud means 70 out of contact with the first cam surface 66 to ensure free operation of the rotatable cam means 64. An adjustable contact screw 112 is threaded in the mandrel holder means 8 for movement therewith and is located so that it will contact a portion 114 of the pivot arm means 44. Just prior to a possible tripping cycle, the cam follower 48 rotates the mandrel holder means 8 in a clockwise direction, indicated by the arrow 116, to move the adjustable contact screw 112 into contact with the portion 114. The pivot arm means 44 is rotatably mounted on the pivot pin 46 so that the continued movement of the adjustable contact screw 112 against the portion 114 rotates the pivot arm means 44 to lift the contact stud means 70 off of the first cam surface 66 so that the rotatable cam means 64 is free to be rotated if either of the solenoid means 92 or 104 has been actuated by the control means 62. The cam follower 48 then rotates the mandrel holder means 8 in a counterclockwise direction to remove the pressure of the adjustable contact screw 112 on the portion 114 so that the pivot arm means 44 rotates around the pivot pin 42 and the contact stud means 70 will move into contact with the second cam surface 68 if the rotatable cam means 64 has been rotated or back into contact with the first cam surface 66 if the rotatable cam means 64 has not been rotated.

In operation, the control means 62 are located at a position where all of the cylindrical containers should be fully seated on the elongated mandrel spindle means 34. The control means 62 are trained on the location where the edge of a properly seated cylindrical container 2 should be and will therefore detect a missing or improperly seated cylindrical container 2. If a missing or improperly seated cylindrical container 2 is detected, the control means 62 sends a signal to either of the solenoid means 92 or 104 so as to move contact rod means 88 or 108 to a position to contact the contact arm means 80 or 84. The movement of the pivot arm means 44 in response to the tripping of the control arm means 80 or 84 is illustrated in FIGS. 5 - 8.

Figure 5:
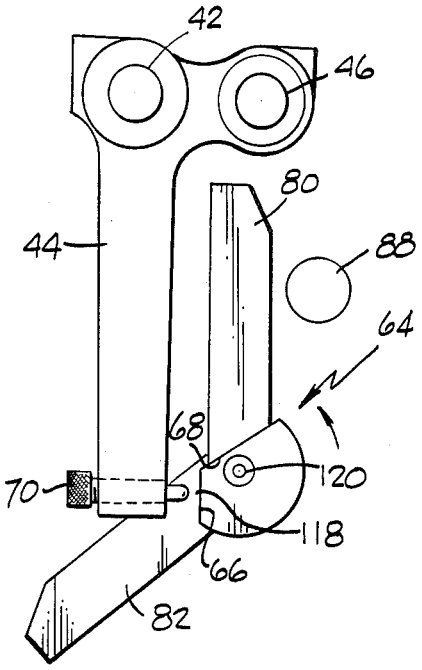
FIGS. 5 and 6 are schematic illustrations of the pivot arm means A in different positions.
Figure 6:
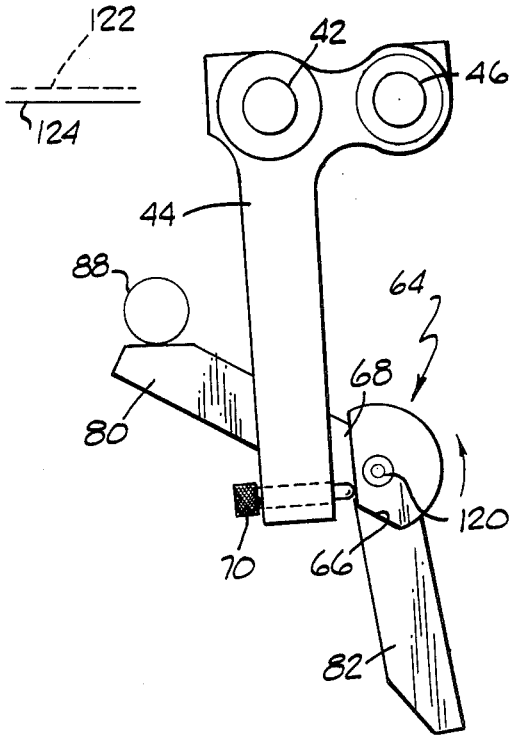

In FIG. 5, the solenoid means 92 has moved the contact rod means 88 to a position wherein the contact arm means 80 will be contacted thereby and cause rotation of the rotatable cam means 64. The pivot arm means 44 has been moved in a clockwise direction by the adjustable contact screw 112, as described above, so that there is a space 118 between the contact stud means 70 and the first cam surface 66 so that the rotatable cam means 64 is free to rotate. In FIG. 6, the rotatable cam means 64 has been rotated and the contact stud means 70 has been moved by the spring 72 into contact with the second cam surface 68. The first cam surface 66 is located at a greater distance from the axis of rotation 120 of the rotatable cam means 64 than the second cam surface 68. Therefore, when the pivot arm means 44 moves from a position wherein the contact stud means 70 is against the first cam surface 66 to a position wherein the contact stud means 70 is in contact with the second cam surface 68, the pivot arm means 44 rotates in a counter-clockwise direction around the pivot pin 46. The counter-clockwise movement of the pivot arm means 44 moves the pivot pin 42 in the same direction so that the pivot pin 42 moves in a radially inward direction toward the central axis of the mandrel wheel means 10. The distance of this radial inward movement is indicated by the distance between the dashed line 122 and the solid line 124 in FIGS. 5 and 6. Since the mandrel holder means 8 is also mounted on the pivot pin 42, it and the elongated mandrel spindle means 34 are moved radially inwardly for substantially the same distance. This radially inward movement is sufficient to prevent contact between an empty elongated mandrel spindle means 34 or a cylindrical container 2 improperly seated thereon and the printing blanket wheel means 12.

Figure 7:
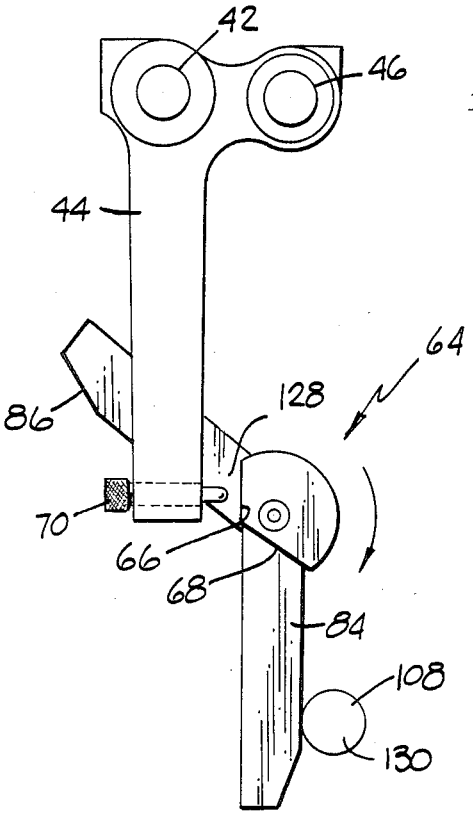
FIGS. 7 and 8 are schematic illustrations of the pivot arm means B in different positions.
Figure 8:
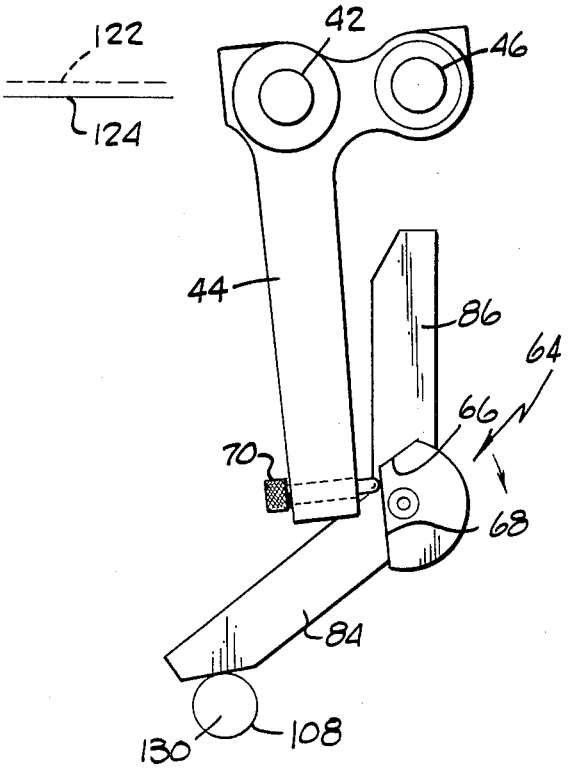

In FIG. 7, the solenoid means 104 has moved the contact rod means 108 to a position wherein the contact arm means 84 will be contacted thereby and cause rotation of the rotatable cam means 64. The pivot arm means 44 has been moved in a clockwise direction by the adjustable contact screw 112, as described above, so that there is a space 128 between the contact stud means 70 and the first cam surface 66 so that the rotatable cam means 64 is free to rotate. In FIG. 8, the rotatable cam means 64 has been rotated and the contact stud means 70 has been moved by the spring 72 into contact with the second cam surface 68. The first cam surface 66 is located at a greater distance from the axis of rotation 130 of the rotatable cam means 64 than the second cam surface 68. Therefore, when the pivot arm means 44 moves from a position wherein the contact stud means 70 is against the first cam surface 66 to a position wherein the contact stud means 70 is in contact with the second cam surface 68, the pivot arm means 44 rotates in a counter-clockwise direction around the pivot pin 46. The counter-clockwise movement of the pivot arm means 44 moves the pivot pin 42 in the same direction so that the pivot pin 42 moves in a radially inward direction toward the central axis of the mandrel wheel means. The distance of this radial inward movement is indicated by the distance between the dashed line 132 and the solid line 134 in FIGS. 7 and 8. Since the mandrel holder means 8 is also mounted on the pivot pin 42, it and the elongated mandrel spindle means 34 are moved radially inwardly for substantially the same distance. This radially inward movement is sufficient to prevent contact between an empty elongated mandrel spindle means 34 or a cylindrical container 2 improperly seated thereon and the printing belt 14.

Each elongated mandrel spindle means 34 is connected through a series of internal channels 140 and hose 142 to a manifold 144 to supply vacuum or air as required in the cycle of operation. After the skip-trip operation, the signal from the control means 62 is relayed to one of two blow-off solenoid valves 146 or 148 which feed air through parts 150 or 152 of manifold 144 thereby blowing off any improperly seated cylindrical container 2. The mandrel holder means 8 remains in the tripped position past the printing blanket wheel means 12, but before reaching the infeed position, the rotatable cam means are rotated so that the contact stud means 70 is in contact with the first cam surface 66. This is accomplished by a fixedly mounted contact rod means 154 located so as to contact control arm means 82 or fixedly mounted contact rod means 156 located to contact control arm means 86. Just prior to such contact, the cam follower 48 will move the adjustable contact screw 112 into contact with the portion 114 to rotate pivot arm means 44 to move contact stud means 70 off of the second cam surface 78 so that the rotatable cam means 64 is free to rotate. The contact rod means 154 and 156 will not contact any control arm means that has not been moved to a skip-print position.

As illustrated in FIG. 4, the axis of rotation of each rotatable cam means 64 is spaced the same distance from the central axis of the mandrel wheel means 10 which in a preferred embodiment of the invention is about 12.50 inches from the central axis of the mandrel wheel means 10. The contact rod means 88 and 108 each have a diameter of about 0.75 inch with the central axis of the contact rod means 88 spaced from the central axis of the mandrel wheel means 10 a distance of about 14.5 inches and the central axis of the contact rod means 108 spaced from the central axis of the mandrel wheel means a distance of about 11.25 inches. A radian from the central axis of the mandrel wheel means 10 passes through the central axes of the contact rod means 108 and 88. This relationship permits successive control arm means 80 to move past the control rod means 88 in the same elapsed time required for successive control arm means 84 to move past the control rod means 108 after being sensed by control means 62. The tripping cycle for a mandrel wheel means 10 must be accomplished within the period of time that it takes successive control arm means 80 or 84 to move past control rod means 88 or 108. In the mandrel wheel means 10 defined above and rotated at the rate to process 1,800 cans per minute, the tripping cycle must be completed in about 0.067 seconds. The solenoid means 92 or 104 require about 0.015 seconds to move the contact rod means to the contacting position, a dwell time of about 0.022 seconds to ensure contact and a retract time of about 0.015 seconds so that only 0.052 seconds is required for a complete cycle. The time for a complete cycle of operation for this invention is substantially less than the time for a complete cycle of operation of other known skip-print processes so that higher rates of cylindrical containers may be processed and/or the control means can be located closer to the point of contact with the print belt to make sure that the time is related to 1800 cams per minute.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A mandrel assembly for use in a continuous printing machine for cylindrical containers comprising:

mandrel wheel means having apparatus for supporting cylindrical containers mounted thereon, said mandrel wheel means having a central axis of rotation which is in parallel alignment with a central axis of rotation of an associated blanket wheel means carrying a printing medium on a circumferential portion thereof for printing on said cylindrical containers carried by said mandrel wheel means;

at least one mandrel holder means, for supporting an elongated mandrel spindle means thereon, pivotally mounted on a circumferential portion of said mandrel wheel means for pivotal movement about a mandrel holder pivot means which is fixedly mounted on said mandrel wheel means and substantially parallel to said mandrel wheel means central axis of rotation;

elongated mandrel spindle means, for supporting a cylindrical container on a peripheral surface thereof, rotatably mounted on said mandrel holder means for rotation about a central axis of rotation which is in substantially parallel, non-coaxial relationship with said mandrel holder pivot means whereby said elongated mandrel spindle means is radially displaceable relative to said central axis of rotation of said mandrel wheel means by pivotal movement of said mandrel holder means about said mandrel holder pivot means;

rotatable cam follower means, for following a cam track means, mounted on said mandrel holder means for rotation about an axis of rotation which is in substantially parallel, non-coaxial relationship with said mandrel holder pivot means whereby said mandrel holder means is pivotally displaced about said mandrel holder means pivot means by radial displacement of said cam follower means relative to said central axis of rotation of said mandrel wheel means;

cam track means operably associated with said cam follower means for guiding said cam follower means and for causing preselected relative radial displacement thereof with respect to said central axis of rotation of said mandrel wheel means for causing preselected radial displacement of said elongated mandrel spindle means relative to said blanket wheel means whereby, when said mandrel wheel means is in a normal operating state wherein said elongated mandrel spindle means has a cylindrical container properly seated thereon, said mandrel spindle means are positioned to urge said cylindrical container into printing contact with said printing blanket wheel means;

skip-print means for moving said mandrel holder means and said elongated mandrel spindle means to a radially inward location when actuated so that an empty elongated mandrel spindle means or an improperly seated cylindrical container thereon will not contact said printing blanket wheel means;

control means for sensing the position of a cylindrical container on said elongated mandrel spindle means or the absence of a cylindrical container on said elongated mandrel spindle means and to actuate said skip-print means in response to an improperly positioned cylindrical container or the absence of a cylindrical container on said elongated mandrel spindle means;

said skip-print means comprising:

pivot arm means pivotally mounted on said mandrel wheel means and rotatably connected to said mandrel holder means;

rotatable cam means mounted for rotation about a fixed axis on said mandrel wheel means and having at least a first cam surface for cooperation with said pivot arm means in holding said cylindrical container on said elongated mandrel spindle means in a position to move into printing contact with said printing blanket wheel means and a second cam surface for cooperation with said pivot arm means in holding said mandrel holder means and said elongated spindle mandrel means at said radially inward location so that an empty elongated mandrel spindle means or an improperly seated cylindrical container thereon will not contact said printing blanket wheel means;

adjustable contact stud means on said pivot arm means;

force applying means for applying a force on said pivot arm means to urge said adjustable contact stud means into contact with said first cam surface or said second cam surface; and rotation producing means for rotating said rotatable cam means so that said adjustable contact stud means will contact said first cam surface or said second cam surface.

2. The invention as in claim 1 wherein:

said axis of rotation of said rotatable cam means is substantially parallel to said central axis of rotation of said mandrel wheel means.

3. The invention as in claim 1 wherein said rotation producing means comprises:

elongated shaft means extending axially outwardly from said rotatable cam means;

fixed bearing means secured to said mandrel wheel means and having said elongated shaft means rotatably mounted therein;

contact arm means fixed on the end of said elongated shaft means opposite to said rotatable cam means and extending radially outwardly from said elongated shaft means so that said contact arm means rotates with said mandrel wheel means;

contact rod means for contacting a portion of said contact arm means to apply a force thereto so as to rotate said elongated shaft means and rotate said rotatable cam means; and moving means for moving said contact rod means between a first location at which said contact rod means will not contact said contact arm means and a second position at which said contact rod means will contact said contact arm means.

4. The invention as in claim 3 wherein said moving means comprises:

solenoid means having a slidable pin means; and said contact rod means secured to an end of said slidable pin means.

5. The invention as in claim 3 and further comprising:

holding means for releasably holding said rotatable cam means in a position so that said adjustable contact stud means is in contact with said first cam surface or said second cam surface.

6. The invention as in claim 5 wherein:

said holding means normally holding said rotatable cam means so that said adjustable stud means is in contact with said first cam surface.

7. The invention as in claim 6 and further comprising:

fixedly mounted contact means mounted in the path of rotation of said contact arm means; and said fixedly mounted contact means located so as to contact another portion of said contact arm means when said adjustable stud means is in contact with said second cam surface so as to rotate said rotatable cam means so that said adjustable stud means is in contact with said first cam surface.

8. The invention as in claim 7 wherein said contact arm means comprises:

a first elongated member extending radially outwardly from said elongated shaft means and located so that a portion thereof can contact said contact rod means; and a second elongated member extending radially outwardly from said elongated shaft means and located so that a portion thereof can contact said fixedly mounted contact means.

9. The invention as in claim 8 wherein:

said first and second cam surfaces are linear.

10. A mandrel assembly for use in a continuous printing machine for cylindrical containers comprising:

mandrel wheel means having apparatus for supporting a plurality of cylindrical containers mounted thereon, said mandrel wheel means having a central axis of rotation positioned in parallel alignment with a central axis of rotation of an associated blanket wheel device carrying a printing medium on a circumferential portion thereof for printing on said cylindrical containers carried by said mandrel wheel means;

a plurality of mandrel holder means, for supporting a plurality of elongated mandrel spindle means thereon, each of said mandrel holder means is pivotally mounted on a circumferential portion of said mandrel wheel means for pivotal movement about a mandrel holder pivot means which is fixedly mounted on said mandrel wheel means and is substantially parallel to said mandrel wheel central axis of rotation;

elongated mandrel spindle means, for supporting a cylindrical container on a peripheral surface thereof, rotatably mounted on each of said plurality of said mandrel holder means for rotation about a central axis of rotation which is in substantially parallel, noncoaxial relationship with said mandrel holder pivot means whereby said elongated mandrel spindle means is radially displaceable relative to said central axis of rotation of said mandrel wheel means by pivotal movement of said mandrel holder means about said mandrel holder pivot means;

rotatable cam follower means for following a cam track means, mounted on each of said plurality of said mandrel holder means for rotation about a central axis of rotation which is in substantially parallel, noncoaxial relationship with said mandrel holder pivot means whereby said mandrel holder means is pivotally displaced about said mandrel holder means pivot means by radial displacement of said cam follower means relative to said central axis of rotation of said mandrel wheel means;

cam track means operably associated with said cam follower means for guiding said cam follower means and for causing preselected relative radial displacement thereof with respect to said central axis of rotation of said mandrel wheel means for causing preselected radial displacement of said elongated mandrel spindle means relative said blanket wheel device whereby when said mandrel wheel means is in a normal operating state wherein said elongated mandrel spindle has a cylindrical container properly seated thereon, said elongated mandrel spindle means are positioned to urge said cylindrical container into printing contact with said printing blanket wheel means;

first skip-print means for moving every other one of said plurality of mandrel holder means and said elongated mandrel spindle means to a radially inward location when actuated so that an empty elongated mandrel spindle means or an improperly seated cylindrical container on said elongated mandrel spindle means will not contact said printing blanket wheel means;

second skip printing means for moving each of the other mandrel holder means and the other elongated mandrel spindle means to a radially inward location so that an empty elongated mandrel spindle means or an improperly seated cylindrical container on said elongated mandrel spindle means will not contact said printing blanket wheel means;

each of said skip printing means comprising:

pivot arm means pivotally mounted on said mandrel wheel means and pivotally connected to said mandrel holder means;

rotatable cam means for rotation about a fixed axis on said mandrel wheel means and having at least a first cam surface for cooperation with said pivot arm means in holding said cylindrical container on said elongated mandrel spindle means in a position to move into printing contact with said printing blanket wheel means and a second cam surface for cooperation with said pivot arm means in holding said mandrel holder means and said elongated mandrel spindle means at said radially inward location so that an empty elongated mandrel spindle means or an improperly seated cylindrical container on said elongated mandrel spindle means will not contact said printing blanket wheel means;

adjustable contact stud means on said pivot arm means;

force applying means for applying a force on said pivot arm means to urge said adjustable contact stud means into contact with said first cam surface or said second cam surface; and rotation producing means for rotating said rotatable cam means so that said adjustable contact stud means will contact said first cam surface or said second cam surface.

11. The invention as in claim 10 wherein:

said axis of rotation of each of said rotatable cam means is substantially parallel to said central axis of rotation of said mandrel wheel means.

12. The invention as in claim 10 wherein each of said rotation producing means comprises:

elongated shaft means extending axially outwardly from said rotatable cam means;

fixed bearing means secured to said mandrel wheel means and having said elongated shaft means rotatably mounted therein;

contact arm means fixed on the end of said elongated shaft means opposite to said rotatable cam means and extending radially outwardly from said elongated shaft means so that said contact arm means rotates with said mandrel wheel means;

contact rod means for contacting a portion of said contact arm means to apply a force thereto so as to rotate said elongated shaft means and rotate said rotatable cam means; and moving means for moving said contact rod means between a first location at which said contact rod means will not contact said contact arm means and a second position at which said contact rod means will contact said contact arm means.

13. The invention as in claim 12 wherein each of said moving means comprises:

first and second solenoid valve means each having a slidable pin means; and said contact rod means secured to an end of each of said slidable pin means.

14. The invention as in claim 12 and further comprising:

holding means for releasably holding each of said rotatable cam means in a position so that said adjustable contact stud means is in contact with said first cam surface or said second cam surface.

15. The invention as in claim 14 wherein:

each of said holding means normally holding said rotatable cam means so that said adjustable stud means is in contact with said first cam surface.

16. The invention as in claim 15 and further comprising:

fixedly mounted contact means mounted in the path of rotation of each of said contact arm means; and said fixedly mounted contact means located so as to contact another portion of each of said contact arm means when said adjustable stud means is in contact with said second cam surface so as to rotate said rotatable cam means so that said adjustable stud means is in contact with said first cam surface.

17. The invention as in claim 16 wherein each of said contact arms means comprises:

a first elongated member extending radially outwardly from said elongated shaft means and located so that a portion thereof may be contacted by said contact rod means when actuated; and a second elongated member extending radially outwardly from said elongated shaft means and located so that a portion thereof contacts said fixedly mounted contact means when said adjustable stud means is in contact with said second cam surface.

18. The invention as in claim 17 wherein:

each of said first and second cam surfaces are linear.

19. The invention as in claim 18 and further comprising:

each of said slidable pin means of said first and second solenoid means having a longitudinal axis; and said longitudinal axis of said slidable pin means of said first solenoid means being spaced a radial distance away from said central axis of said mandrel wheel means greater than the radial distance between said longitudinal axis of the slidable pin means of the second solenoid valve means and said central axis of said mandrel wheel means.

20. The invention as in claim 19 and further comprising:

said longitudinal axes of said slidable pin means of said first and second solenoid means being located on a radian from said central axis of said mandrel wheel means.

* * * * *